United States Patent [19]

Atkinson

[11] Patent Number: 4,747,860

[45] Date of Patent: May 31, 1988

[54] AIR SEPARATION

[75] Inventor: Timothy D. Atkinson, London, England

[73] Assignee: The BOC Group plc, Windlesham, England

[21] Appl. No.: 89,272

[22] Filed: Aug. 25, 1987

[30] Foreign Application Priority Data

Aug. 28, 1986 [GB] United Kingdom ..... 8620754

[51] Int. Cl.[4] ..... F25J 3/04

[52] U.S. Cl. ..... 62/22; 55/66; 62/24

[58] Field of Search ..... 62/22, 24, 38; 55/66

[56] References Cited

U.S. PATENT DOCUMENTS

| | | | |
|---|---|---|---|
| 3,222,878 | 12/1965 | Becker | 62/22 |
| 3,543,528 | 12/1970 | Crawford et al. | 62/22 |
| 3,688,513 | 9/1972 | Streich et al. | 62/22 |
| 4,533,375 | 8/1985 | Erickson | 62/22 |
| 4,575,388 | 3/1986 | Okada | 62/22 |
| 4,578,095 | 3/1986 | Erickson | 62/22 |
| 4,604,116 | 8/1986 | Erickson | 62/22 |
| 4,605,427 | 8/1986 | Erickson | 62/22 |
| 4,615,716 | 10/1986 | Cormier et al. | 62/24 |

*Primary Examiner*—Ronald C. Capossela

*Attorney, Agent, or Firm*—R. Hain Swope; Larry R. Cassett

[57] ABSTRACT

In a process for the separation of argon from air by distillation in a plurality of distillation columns, liquid oxygen and gaseous nitrogen, withdrawn from a distillation column, are introduced into opposing ends of a mixing zone and there are created opposing flows of liquid and vapor that become progressively richer in nitrogen and oxygen, in the direction of flow. A mixed stream containing both oxygen and nitrogen is withdrawn as waste or product from an intermediate point in the mixing zone. The mixing zone also provides for condensation and reintroduction of oxygen-rich vapor and return of liquid nitrogen to the distillation column. The distillation column further provides an intermediate condenser which provides intermediate reboil for the distillation column.

14 Claims, 2 Drawing Sheets

AIR SEPARATION

This invention relates to a method and apparatus for separating argon from air.

BACKGROUND OF THE INVENTION

Traditionally, in separating air, if argon is to be obtained as a product gas, the incoming air is separated into relatively pure streams of oxygen, nitrogen and argon. European Patent Application No. 136 926A, for example, discloses the operation of a conventional double column with argon "side-draw" for producing nitrogen, oxygen and argon products. In the process disclosed in the European Patent Application, advantage is taken of a temporary fall in the oxygen demand in order to increase the production of one or more of the other products, for example argon. A liquid is thus taken from one of the two columns forming the double column and is passed to the top of an auxiliary column or mixing column operating at substantially the pressure of the low pressure column. A gas whose oxygen content is less than that of the liquid is taken from the low pressure column and is passed to the bottom of the auxiliary column. A liquid collected at the bottom of the auxiliary column is passed as reflux into the low pressure column at substantially the level from which the said gas is taken. As more oxygen-rich liquid is taken from the double column and passed to the auxiliary column, more reflux may be provided for the low pressure column, thereby making possible an increase in the rate of argon production. However, this method involves substantial inefficiencies which makes it unsuitable for use in a plant for producing argon as the primary or sole product of air separation.

In our copending British patent application No. 8611536 there is disclosed to a method of separating argon from air in which an improvement in the operation of the auxiliary or mixing zone is made possible. In the mixing zone, a liquid flow and an opposed vapor flow are established which become progressively richer in nitrogen and oxygen, respectively. A mixed waste stream containing both nitrogen and oxygen is withdrawn from an intermediate point of the mixing zone and fluid therefrom is utilized to provide heat transfer in the process. The present invention relates to a process and apparatus for separating argon from air which enables further improvement to be obtained in the operation of the mixing zone.

SUMMARY OF THE INVENTION

The present invention provides an improved process for the separation of argon from a gaseous mixture and apparatus therefor. In the process, a stream of air is passed into a first distillation column. An oxygen-rich liquid withdrawn from a bottom region of the distillation column is passed to the top region of a mixing zone. Nitrogen-rich vapor withdrawn from the distillation column is passed to a bottom region of the mixing zone. A downward flow of liquid which becomes progressively richer in nitrogen and an upward flow of vapor which becomes progressively richer in oxygen are established in the mixing zone. A stream having an argon concentration greater than that of the air stream is withdrawn from the first distillation column and separated in a second distillation column to produce an argon product. A vapor stream is withdrawn from the mixing zone at a point intermediate the top and the point of withdrawal of the mixed stream, condensed in heat exchange of the distillation columns and returned to the mixing zone. The boiled liquid is returned to its distillation column.

DETAILED DESCRIPTION OF THE INVENTION

Figure 1:
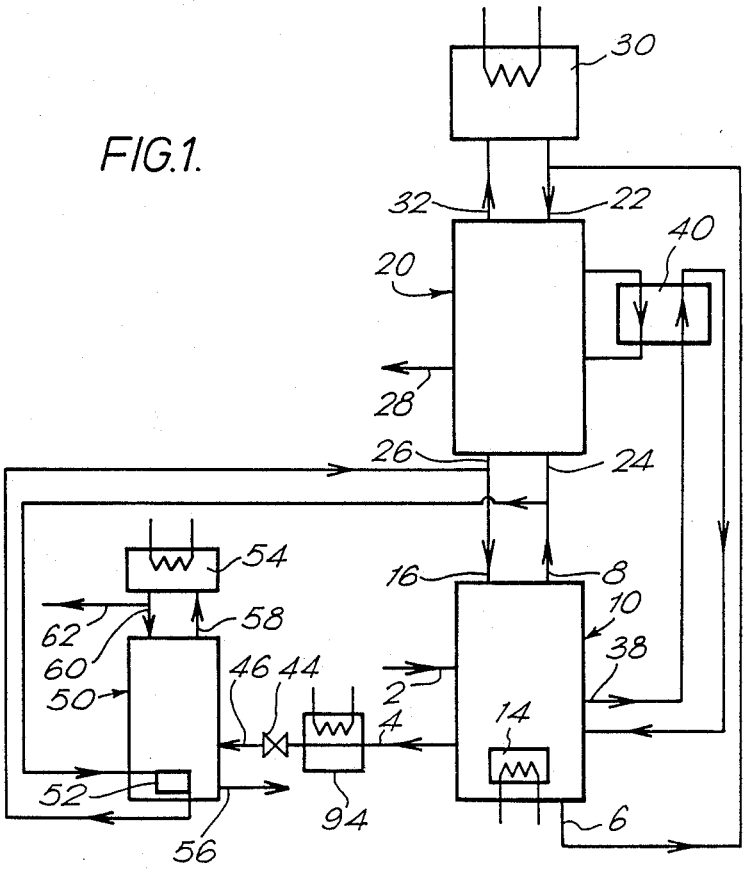
FIG. 1 is a simplified circuit diagram showing an arrangement of liquid-vapor contact columns for use in generating argon in accordance with the invention.

In accordance with the present invention and referring to FIG. 1, an air stream from which low volatility constitutents and low volatility impurities, such as carbon dioxide and water vapor, have been removed is introduced into a single distillation column 10 through an inlet 2 at a pressure of typically about 5 atmospheres absolute and at a temperature typically at its dew point. Such low volatility impurities may, for example, be removed from the air stream in a reversing heat exchanger or heat exchangers. Typically, the reversing heat exchanger is cleaned by the mixed stream withdrawn from the mixing zone, in which case, in order to maintain a desired cleaning ratio, a portion of the mixed stream is expanded through a turbine so as to give cleaning gas for the reversing heat exchangers at two different pressures.

The distillation column 10 is provided with a suitable number of liquid-vapor contact trays (not shown) to enable the incoming air to be separated into an oxygen-enriched liquid which collects at the bottom of the column 10 and a nitrogen-enriched vapor which collects at the top of the column 10. Liquid nitrogen reflux for the column 10 is provided through inlet 16 at the top of the column and reboil for the column is provided by a reboiler 14 in the bottom region thereof. The properties of the fluid mixture in the column 10 are such that a maximum concentration of argon is obtained in the liquid and vapor phases at a level below that of the inlet 2, and whereas the incoming air contains in the order of 0.9% by volume of argon, a liquid fraction typically containing on the order of 8% by volume of argon may be withdrawn from the column 10 through the outlet 4.

Although it is desired that the vapor drawn from the top of the first distillation column be essentially free of argon, it may contain oxygen in a concentration of up to about 20.95% by volume, corresponding to an oxygen concentration of up to about 38% by volume in the liquid phase. In practice, it is desirable that the liquid at the top of the first distillation column contains from about 1% to 10%, preferably about 2.5%, by volume of oxygen. Efficient operation of both the first distillation column and the mixing zone is enhanced as well by choosing an operating pressure for them of above 3 atmospheres absolute. Typically, the first distillation column and the mixing zone are operated at pressures in the order of 5 atmospheres. In conventional double distillation columns, however, it is usually desirable to operate the second distillation column at a pressure in the range of 1 to 2 atmospheres absolute. Accordingly, it is preferred that the second distillation column operates at a lower pressure than the first distillation column.

In order to form the reflux and reboil for the distillation column 10, it is necessary to add energy to the system in the form of heat pumping. To reduce the amount of energy from an external source that it is required, a liquid-vapor contact or mixing column 20 is employed to mix liquid oxygen and gaseous nitrogen fractions from the distillation column 10 and thus produce liquid nitrogen which is returned to the column 10 as reflux. Accordingly, a liquid oxygen stream is withdrawn from the bottom of the distillation column 10 through an outlet 6 and is passed to an inlet 22 at the top of the mixing column 20. Gaseous nitrogen is taken from the top of the distillation column 10 through the outlet 8 and is passed into an inlet 24 at the bottom of the mixing column 20. The mixing column 20 operates at substantially the same pressure as the distillation column 10 and is provided with a number of liquid-vapor contact trays (not shown) to enable initimate contact to take place between the liquid and vapor phases. It is desirable that the relationship between the liquid and the vapor on each tray is relatively close to equilibrium, and accordingly, the mixing column 20 typically has a relatively large number of trays, for example 50 or more. Operation of the mixing column 20 at conditions relatively close to equilibrium significantly enhances its efficiency.

As the liquid descends the mixing column 20 it becomes progressively richer in nitrogen. Thus, a liquid nitrogen stream is able to pass out of the mixing column 20 through an outlet 26 to form part of the liquid nitrogen reflux stream that enters the distillation column 10 through the inlet 16. A mixed stream comprising oxygen and nitrogen is withdrawn from an intermediate location in the mixing column 20 through an outlet 28. This mixed stream can be a waste stream or a product stream as discussed hereinafter. The relative proportions of oxygen and nitrogen in the mixed stream withdrawn through the outlet 28 may be the same as in the incoming air. It is to be appreciated, however, that the stream withdrawn through the outlet 28 is relatively lean in argon compared with the air entering the distillation column 10 through the inlet 2 since most of this argon is subsequently withdrawn again through the outlet 4. It is also to be appreciated that it is not essential that the oxygen to nitrogen ratio of the stream withdrawn through the outlet 28 be the same as that the incoming air depending on its intended use. If the mixed stream is withdrawn as product, it is oxygen-rich and the operating pressure of the column 20 are selected so as to produce the stream at a pressure slightly in excess of the pressure at which it is desired to be supplied to a plant in which the stream can be utilized, e.g. in a combustion process.

We have found that operation of the mixing column 20 at pressures in excess of 3 atmospheres facilitates the recovery of energy in the form of liquid nitrogen reflux from the column 20. Such recovery of energy is also facilitated by employing a condenser 30 at the top of the mixing column 20 so as to enhance the reflux supplied to the column. Thus, oxygen in the gaseous phase is withdrawn from the top of the mixing column 20 through the outlet 32 and is condensed in a condenser 30, the resulting liquid oxygen being combined with the liquid oxygen being withdrawn from the first distillation column 10 through the outlet 6 and then being fed to the mixing column 20 through the inlet 22. Preferably, the liquid oxygen that enters the mixing column 20 through the inlet 22 is not pure, i.e. it contains an appreciable proportion of nitrogen. The use of the condenser 30 in association with the mixing column 20 is the subject of our co-pending British patent application No. 8611536.

We have further found that, particularly at pressures above 3 atmospheres, in order to maintain the operating conditions in the mixing column 20 to the equilibrium, a second stream of vapor may be taken from a level of the column 20 intermediate the level of the outlet 28 and the top of the column and be condensed in a condenser 40. The resulting condensate is returned to the column at a level below that at which the vapor for condensation is taken from the column. The level at which the condensate from the condenser 40 is returned to the mixing column 20 is selected so that the composition of the condensate corresponds approximately to that of the liquid into which it is reintroduced. In order to provide cooling for the condenser 40, a stream of liquid is withdrawn from the distillation column 10 through an outlet 38 at a level below that of the inlet 2. The liquid that is withdrawn from the distillation column 10 through the outlet 38 is reboiled in the condenser 40 and resulting vapor is returned to the distillation column 10 at a level such that its composition corresponds approximately to that of the vapor into which it is reintroduced. This "intermediate" reboiling of the liquid withdrawn from the distillation column 10 through the outlet 38 also helps to improve the efficiency with which the distillation column 10 operates.

The argon enriched liquid oxygen that is withdrawn from the distillation column 10 through the outlet 4 is subjected to further distillation or rectification in the second distillation or argon column 50. Whereas in conventional air spearation plants, the column that is employed to distil an argon-enriched oxygen stream is operated at substantially the same pressure as the distillation column from which the stream is taken, it is preferred process in accordance with the present invention that the column 50 is operated at a lower pressure than the column 10, for example, at a pressure a little above atmospheric. Accordingly, the argon-containing stream withdrawn through the outlet 4 is in liquid form, is sub-cooled in a heat exchanger 94, is then passed through a throttling valve 44 and enters the column 50 through an inlet 46 as liquid.

This arrangement makes possible the efficient operation of the column 50 within a relatively wide range of pressures. The column 50 is provided with liquid-vapor contact trays (not shown) in order to facilitate mass exchange between the liquid and vapor phases. The column 50 is further provided with a reboiler 52 at the bottom region thereof and a condenser 54 associated with the top thereof. A liquid oxygen fraction collects at the bottom of the column 50 and a stream of liquid oxygen is typically withdrawn from the column 50 through the outlet 56. Argon-enriched gas collects at the top of the column 50 and is withdrawn therefrom through an outlet 58 leading to the condenser 54 where it is condensed. Some of the resulting condensate is returned to the column 50 as reflux through an inlet 60 at its top and the remainder is withdrawn as a crude argon product through outlet 62. The argon product, which is preferably produced in the liquid phase may, if desired, be subjected to further purification as it typically contains up to 20% by volume of oxygen.

In accordance with an unique feature of the process the invention, the reboil for the argon column 50 is provided by taking a portion of the gaseous nitrogen leaving the top of the distillation column 10 through the outlet 8 and passing it through the reboiler 52, the nitrogen thereby being condensed. The resultant liquid nitrogen is returned to the column 10, being united with the liquid nitrogen that leaves the mixing column 20 through the outlet 26. Accordingly, the reboiler 52 also acts as a condenser providing reflux for the distillation column 10.

Figure 2:
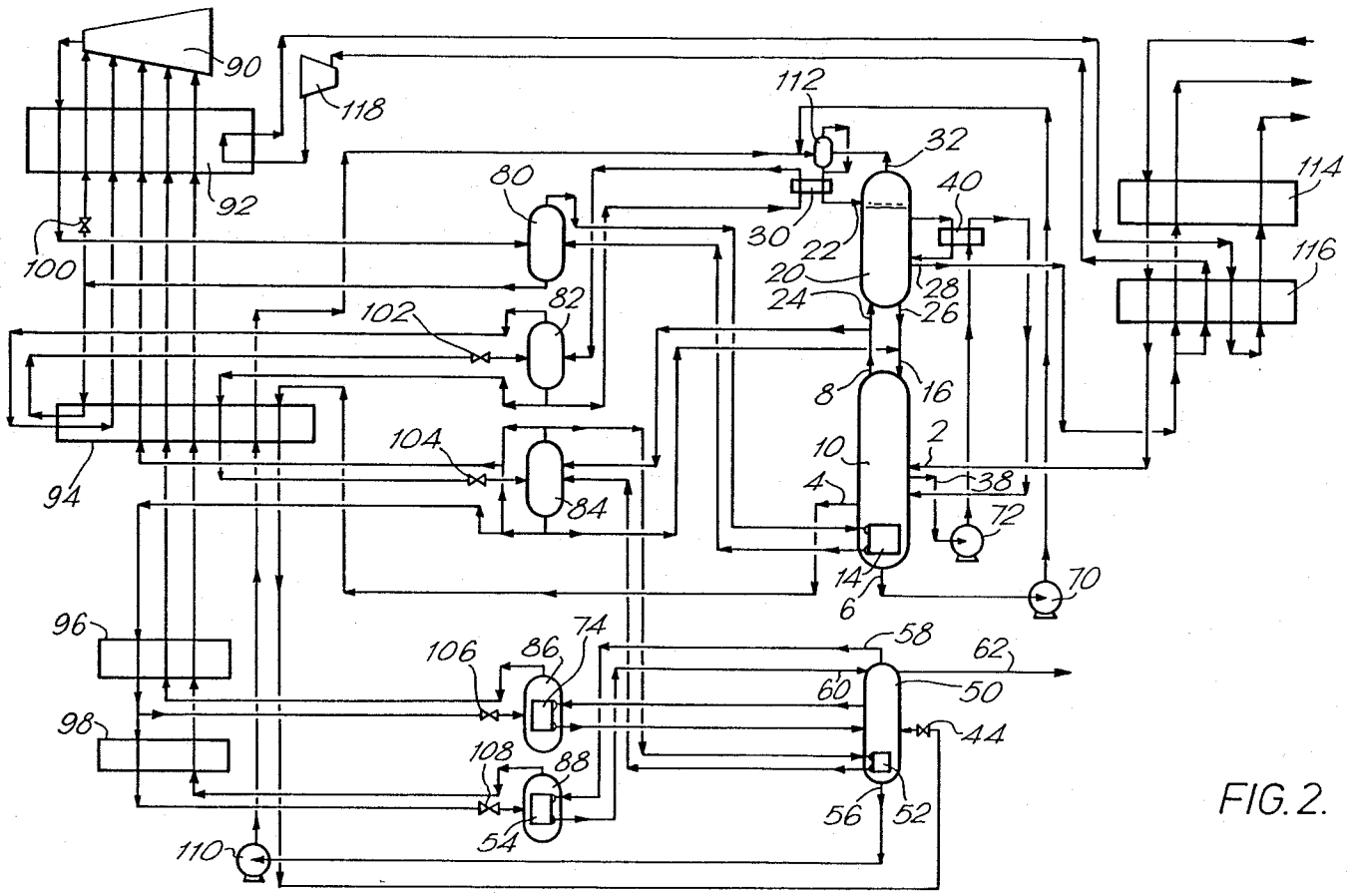
FIG. 2 is a circuit diagram of an argon generator employing the arrangement of columns shown in FIG. 1.

In a plant embodying the column system shown in FIG. 1, cooling for the condensers 30 and 54 and for the subcooler 94 may be provided by nitrogen generated in the distillation column 10. Similarily, such nitrogen may be employed as the source of heat for the reboiler 14. One such plant is illustrated in FIG. 2 of the accompanying drawings. In the description of FIG. 2, the same reference numerals as used in FIG. 1 shall be employed to indicate items of plant that are common to both Figures. Moreover, the operation of those parts of the plant that are shown in FIG. 1 will not be described again in any detail.

The arrangement of columns employed in the plant shown in FIG. 2 is generally similar to that shown in FIG. 1. In order to assist the flow of liquid oxygen from the bottom of the distillation column 10 to the top of the mixing column 20, a pump 70 is employed, and a similar pump 72 is used to pump the liquid stream from the outlet 38 of the distillation column 10 through the condenser-reboiler 40. In addition, an additional condenser 74 is employed in association with the argon column 50. Vapour is taken from the column 50 through an outlet above that of the inlet to the column for the argon-enriched oxygen withdrawn from the distillation column 10. This vapor is then condensed in the condenser 74 and is returned as liquid in the column 50 at a level where the composition of the liquid corresponds approximately to that of the condensate. Moreover, liquid oxygen from the bottom of the column 50 is passed to the top of the mixing column 20 as will be described below. In other respects, the arrangement of columns shown in FIG. 2 is generally similar to that shown in FIG. 1.

The plant shown in FIG. 2 does, however, contain a number of features not shown in FIG. 1 or described with respect thereto. In particular, the plant shown in FIG. 2 provides preferred embodiments of this invention in that nitrogen is available at five different pressures to perform heat pumping duty for the subject process and has the following features:

(a) a nitrogen distribution and refrigeration system which, in addition to providing a working fluid, comprising nitrogen, to the reboiler 52 of the argon column 50, also provides nitrogen to cool the condensers 54, 74 and 30 and to heat the reboiler 14;

(b) a reversing heat exchanger system for purifying and cooling the incoming air.

The nitrogen distribution system includes five nitrogen distribution pots, 80, 82, 84, 86 and 88, each operating at a different pressure. Each of the pots receives and distributes gaseous and liquid nitrogen streams performing heat pumping duty. The pots 80 and 82 provide nitrogen at higher pressure than the operating pressure of the columns 10 and 20 to the reboiler 14 and the condenser 30, respectively. The pressure in the pot 80 is higher than that of the pot 82. The pot 82 houses the condenser 30. The pot 84 operates at approximately the same pressure as that of the columns 10 and 20 and provides an intermediate region of the vapor path from the outlet 26 of the mixing column 20 to the reboiler 14 of the distillation column 10 and also an intermediate region of the liquid path from the reboiler 14 of the column 10 to the inlet 8 to the column 10.

The pots 86 and 88 operate at lower pressures than those at which the columns 10 and 20 operate. Pot 86 provides cooling for the condenser 74 associated with the argon column 50 while the pot 88, which operates at a lower pressure than the pot 86, provides cooling for the condenser 54 associated with the argon column 50. The condensers 74 and 54 are located in the pots 86 and 88 respectively.

In addition to providing gaseous nitrogen to the reboiler 14 and receiving liquid nitrogen therefrom, the pot 80 receives a compressed, gaseous nitrogen stream from a multistage compressor 90. In order to provide cooling for nitrogen supplied to the pots 80, 82, 84, 86 and 88, a sequence of heat exchangers 92, 94, 96 and 98 is provided. A compressed nitrogen stream leaving the compressor 90 flows through the heat exchanger 92 from its warm end at about ambient temperature, is cooled to about its dew point and is then introduced into the pot 80. A stream of liquid nitrogen is withdrawn from the bottom of the pot 80 (at a rate equal to that which the compressed nitrogen is introduced into the pot 80), and is then divided in two. One part of the stream is expanded through valve 100 and is then returned through the heat exchanger 92 countercurrently to the aforesaid compressed nitrogen stream. After being warmed to about ambient temperature, this nitrogen is then returned to the highest pressure stage of the compressor 90 for recompression.

That part of the liquid nitrogen stream withdrawn from the bottom of the pot 80 that is not expanded through the valve 100 is further reduced in temperature in the heat exchanger 94. It enters the heat exchanger 94 at its warm end, is withdrawn from an intermediate region thereof, is passed through an expansion valve 102 and is then introduced as liquid into the pot 82.

The pot 82, as well as providing a liquid nitrogen stream to condense the oxygen in the condenser 32 associated with the mixing column 20 and receiving the resultant vaporized nitrogen, also provides a gaseous nitrogen stream which provides cooling for the heat exchangers 94 and 92 and is then recompressed in a stage of the compressor 90. Thus, the gaseous nitrogen stream is withdrawn from the top of the pot 82, is introduced into the heat exchanger 94 at a region intermediate its cold and warm ends and then flows through the heat exchanger 94 leaving the heat exchanger at its warm end. This nitrogen stream then passes through the heat exchanger 92 from its cold end to its warm end and is recompressed in the compressor 90.

A liquid nitrogen stream is also withdrawn from the pot 82, and, after passage through the heat exchanger 94 from its warm to its cold end, is expanded through valve 104 into the pot 84. The pot 84, as well as receiving nitrogen from the outlet 26 of the mixing column 20, passing nitrogen to the condenser 14, receiving return nitrogen from the condenser 14 and returning nitrogen to the top of the distillation column 10 through the inlet 16, also provides liquid nitrogen to the pots 86 and 88 and returns gaseous nitrogen to the compressor 90. Thus, a gaseous nitrogen stream is withdrawn from the top of the pot 84 and flows through the heat exchangers 94 and 92, passing through each heat exchanger from its cold end to its warm end, and is then compressed in a stage of the compressor 90. This gaseous nitrogen stream is mixed with some liquid withdrawn from some of the pot 84. Further liquid from the bottom of the pot 84 passes through a heat exchanger 96 flowing from its warm to its cold end. Part of this liquid nitrogen is then expanded through valve 106 into the pot 86, while the remainder flows through the heat exchanger 98 from its warm to its cold end and is expanded through valve 108 into the pot 88. A gaseous nitrogen stream is withdrawn from the top of the pot 86 and is returned to the compressor 90 flowing through the heat exchangers 96, 94 and 92 in sequence. Similarly, a gaseous nitrogen stream is withdrawn from the top of the pot 88 and flows through the heat exchangers 98, 96, 94 and 92, in sequence, and is recompressed in the compressor 90.

As well as providing cooling and warming of the nitrogen streams, the heat exchanger 94 is employed to sub-cool the argon-enriched oxygen stream withdrawn from the column 10 through the outlet 42. In addition, liquid oxygen withdrawn from the argon column 50 through the outlet 56 is pumped by a pump 110 through the heat exchanger 94 countercurrently to the flow of the argon-enriched liquid oxygen stream and is then mixed with the liquid oxygen stream pumped from the outlet 6. The resulting mixture is introduced into a pot 112 where it is mixed with gaseous oxygen leaving the top of the mixing column 20 through the outlet 32. The resulting 2-phase mixture is withdrawn from the pot 112 and is fully condensed in the condenser 30 before being returned to the column 20 through the inlet 22.

In order to provide cooling and cleaning for the incoming air stream, reversing heat exchangers 114 and 116 are provided. The air is cooled to its dew point by passage through the heat exchangers 114 and 116. Refrigeration for the heat exchangers is provided by taking the nitrogen-oxygen stream vented from the column 20 through the outlet 28 and passing through the heat exchange 116 and 114 countercurrently to the incoming air. A part of the aforesaid nitrogen-oxygen stream is however divided from the main stream upstream of the cold end of the heat exchange 116 and is passed through the heat exchanger 116 countercurrently to the incoming air stream. It is then expanded to a pressure a little above atmospheric pressure in an expansion turbine 118 with the performance of external work. The resulting nitrogen stream provides some refrigeration for the heat exchanger 92 and is then returned through the heat exchanger 116 flowing cocurrently with the incoming air stream. The expanded air is then returned through the heat exchanger 116 countercurrently to the incoming air flow and then passes through the heat exchanger 114 from the cold to the warm end thereof. The nitrogen-oxygen streams that leave the warm end of the heat exchanger 114 may be further expanded to recover work.

During its passage through the heat exchanger 114 and 116, carbon dioxide, water vapor and other low volatility impurities are deposited. In a manner well known in the art, once the cleaning ability of the reversing heat exchanger 114 and 116 begins to decline, the passages traversed by the incoming and returning air streams are switched so that the returning air streams can be used to resublime solid impurities deposited on the heat exchange surfaces. Thus, the heat exchangers 114 and 116 may be used continuously to provide purified air to the inlet of the distillation column 10. It is desirable to employ relatively high and low pressure streams to effect the cleaning of the heat exchangers 116 and 114 as difficulties can arise if just a relatively high pressure air stream is used, that is if none of the air is expanded through the turbine 118.

The present invention also provides apparatus for separating argon from air, comprising:

(a) means for passing a stream of air into a first distillation column;

(b) means for withdrawing an oxygen-rich liquid from a bottom region of the first distillation column and passing it to a top region of a mixing zone;

(c) means for passing nitrogen rich vapor from the first distillation column to a bottom region of the mixing zone;

(d) liquid-vapor contact means for establishing through the mixing zone a downward flow of liquid that becomes progressively richer in nitrogen in the direction of liquid flow and an upward flow of vapor that becomes progressively richer in oxygen in the direction of vapor flow;

(e) means for passing liquid nitrogen from the mixing zone to the first distillation column to act as reflux;

(f) means for withdrawing as product or waste a mixed stream comprising oxygen and nitrogen from an intermediate level of the mixing zone;

(g) a condenser for condensing oxygen-rich vapor at the top of the mixing zone;

(h) means for withdrawing from the first distillation column a stream of argon-containing fluid whose argon concentration is greater than that of the air stream, said means communicating with a second distillation column for separating an argon product from the argon-containing stream; and (i) means for withdrawing a vapor stream from a level of the mixing zone above that of the level from which said mixed stream is, in operation, withdrawn, but below the top of the mixing zone;

(j) means for condensing said vapor stream in heat exchange with a stream of boiling liquid from one of the distillation columns and returning a stream of thus-formed condensate to the mixing zone; and (k) means for returning boiled liquid to its respective distillation column.

The mixing zone may be provided in a separate column from the first distillation column, or may be included in the first distillation column, above a distillation zone therein. The means communicating with the second distillation column for separating an argon product, typically a condensor, is preferably amalgamated with the reboiler for the first distillation column in a condensor-reboiler.

In an illustrative example of the method according to the invention employing the plant shown in FIG. 2, air enters the distillation column 10 through the inlet 2 at a flow rate of 1000 standard cubic meters per hour and at a temperature of about 101.5 K and pressure of 5.5 atmospheres absolute. A liquid oxygen stream, enriched in argon, comprising approximately 92% by volume of oxygen and 8% by volume of argon, is withdrawn from the column 10 through the outlet 42 at a rate of 111.2 standard cubic meters per hour at a temperature of about 110 K and a pressure of about five and half atmospheres absolute. It is sub-cooled to a temperature of 92 K by passage through the heat exchanger 94 and expanded to a pressure of about 1.3 atmospheres absolute through the valve 46, prior to being introduced into the column 50. A liquid oxygen stream comprising about 99.9% by volume of oxygen and 0.1% of argon is withdrawn from the bottom of the argon column 50 at a flow rate of about 102.3 standard cubic meters per hour, a temperature of about 93.5 K and a pressure of about 5.15 atmospheres absolute. This liquid oxygen stream is warmed to temperature of about 105.5 K in the heat exchanger 94 and is then mixed with liquid oxygen from the bottom of the distillation column 10. The resulting mixture is, in turn, mixed in a pot 112 with vaporous oxygen leaving the mixing column 20. The resulting mixture is fully condensed in the condenser 30 and is then introduced into the top of the mixing column 20. This stream typically comprises 97.5% by volume of oxygen with the balance being nitrogen and argon. Liquid argon (comprising 98% by volume of argon, 1.8% by volume of oxygen and 0.2% by volume of nitrogen) is typically drawn from the top of the column 50 through the outlet 62 at a rate of about 9 standard cubic meters per hour.

The nitrogen streams passing to and from the pots 80, 82, 84, 86 and 88 are of the same purity as the nitrogen vapor from the top of the distillation column 10, containing about 1% by volume of oxygen. The pot 80 operates at an average pressure of about 17¼ atmospheres absolute and at a temperature of 116 K; the pot 82 at a pressure of about 11 atmospheres absolute and at a temperature of about 105 K; the pot 84 operates at a pressure of about 5.4 atmospheres absolute and a temperature of about 95 K; the pot 86 operates at a pressure of about 3.5 atmospheres absolute and a temperature of about 89.5 K; and the pot 88 at a pressure of about 2 atmospheres absolute, and a temperature of about 84 K.

The flow rates of nitrogen into and out of the compressor are as follows: nitrogen from the pot 88 enters the lowest pressure stage of the compressor 90 at a pressure of 1.75 atmospheres and a flow rate of about 146.8 standard cubic meters per hour; nitrogen from the pot 82 enters the next stage of the compressor 90 at a pressure of 3.23 pk atmospheres and a flow rate of 196.5 standard cubic meters per hour; nitrogen from the pot 84 enters the next stage of the compressor 90 at a pressure of 5.22 atmospheres and a flow rate of 68.8 standard cubic meters per hour. Nitrogen from the pot 82 enters the next stage of the compressor at a pressure of 10.86 atmospheres and a flow rate of 317.0 standard cubic meters per hour; and nitrogen from the pot 80 enters the highest pressure stage of the compressor 90 at a pressure of 17.4 atmospheres absolute and a flow rate of about 30.0 standard cubic meters per hour. Compressed nitrogen leaves the highest pressure stage of the compressor 90 at a pressure of 17.3 atmospheres absolute and a flow rate of 759 standard cubic metres per hour. A mixed nitrogen-oxygen stream is withdrawn from the mixing column 20 at a rate of 991 standard cubic meters per hour and a temperature of about 99 K. Of this stream, 798.3 standard cubic meters per hour flows straight through the heat exchangers 116 and 114, being vented to the atmosphere from the warm end of the heat exchanger 114 at approximately ambient temperature. The remainder of the stream leaves the heat exchanger 116 at a temperature of 180 K and is expanded to a pressure of about 1.25 atmospheres and a temperature of 130 K in the expansion turbine 118. The stream is then warmed to a temperature of 64.5 K in the heat exchanger 92 before returning from the warm end to the cold end of the heat exchanger 116 and then flowing back through the heat exchanger 116 and the heat exchanger 114, and being vented to the atmosphere.

The gaseous stream of intermediate composition withdrawn from the column 20 for condensation in the heat exchanger 40 comprises about 57% by volume of oxygen, about 42.9% by volume of nitrogen and 0.09% by volume of argon. The liquid stream withdrawn from the first distillation column 10 through the outlet 38 for reboil in the heat exchanger 40 against the condensing gaseous stream of intermediate composition comprises about 38.8% by volume of oxygen, about 59.1% by volume of nitrogen, and 2.1% by volume of argon. The flow rate of this liquid stream is 170 standard cubic meters per hour whereas the flow rate of the gaseous stream against which it is heat exchanged in the heat exchanger 40 is 183 standard cubic meters per hour.

I claim:

1. In a process for the separation of argon from air comprising introducing a stream of air into a first distillation column, withdrawing therefrom a stream of argon-containing fluid having an argon concentration greater than said stream of air and separating an argon product from said fluid in a second distillation column, wherein oxygen-rich liquid is withdrawn from said first distillation column and introduced into one end of a mixing zone, a nitrogen-rich vapor is withdrawn from said first distillation column and introduced into the opposite end of the mixing zone, a liquid flow and an opposed vapor flow are established through said mixing zone which become progressively richer in nitrogen and oxygen, respectively, a mixed stream comprising oxygen and nitrogen is withdrawn from an intermediate point in said mixing zone and said oxygen-rich vapor is condensed and returned to the mixing zone, the improvement wherein liquid nitrogen is passed from the mixing zone to the first distillation column, and a vapor stream is withdrawn from the mixing zone at a point intermediate in the direction of a vapor flow between the point of withdrawal of said mixed stream and the end of the zone, said vapor stream is condensed in heat exchange with a stream of boiling liquid from one of said distillation columns, said condensed stream is returned to the mixing zone and said boiled liquid is returned to said distillation column.

2. A process in accordance with claim 1, wherein the stream of boiling liquid is withdrawn from the first distillation column at a level below that at which the air stream is introduced and said liquid is returned to said column at a point below that at which is was withdrawn.

3. A process in accordance with claim 1, wherein the second distillation column operates at a lower pressure than the first distillation column, and the said argon-containing stream is withdrawn from the first column as a liquid, is sub-cooled and is passed into the second distillation column through a throttling valve.

4. A process in accordance with claim 1, wherein said stream of nitrogen vapor withdrawn from the first distillation column is utilized to reboil liquid in or from a bottom region of the second distillation column, thereby being condensed and the resulting condensate is reintroduced into the first distillation column as reflux.

5. A process in accordance with claim 1, additionally including the step of condensing argon at or from the top of the second distillation column, employing a portion of the condensed argon as reflux for the second column and withdrawing the remainder of condensed argon as product.

6. A process in accordance with claim 1, additionally including the step of removing low volatility impurities from the air stream in one or more reversing heat exchangers upstream of the first distillation column.

7. A process in accordance with claim 6 wherein the reversing heat exchangers are cleaned by said mixed stream from the mixing zone, said process additionally including the step of expanding a portion of the mixed stream, so as to give cleaning gas at two different pressures.

8. A process in accordance with claim 1, wherein a stream of liquid oxygen is withdrawn from the bottom of the second distillation column and introduced into the top of said mixing zone.

9. A process in accordance with claim 1, wherein the mixed stream has a ratio of oxygen to nitrogen greater than that of the incoming air stream and is withdrawn as product.

10. A process in accordance with claim 1, additionally including the step of withdrawing a stream of vapor from a level of the second distillation column intermediate that at which the argon-containing stream is introduced and the top of the second column, condensing the stream of vapor and returning it to the second column.

11. Apparatus for separating argon from air comprising:

(a) means for passing a stream of air into a first distillation column;

(b) means for withdrawing an oxygen-rich liquid from a bottom region of the first distillation column and passing it to a top region of a mixing zone;

(c) means for passing nitrogen-rich vapor from the first distillation column to a bottom region of said mixing zone;

(d) liquid-vapor contact means for establishing through the mixing zone a downward flow of liquid that becomes progressively richer in nitrogen in the direction of liquid flow and an upward flow of vapor that becomes progressively richer in oxygen in the direction of vapor flow;

(e) means for passing liquid nitrogen from the mixing zone to the first distillation column to act as reflux;

(f) means for withdrawing a mixed stream comprising oxygen and nitrogen from an intermediate level of mixing zone;

(g) condensing means for condensing oxygen-rich vapor at the top of the mixing zone;

(h) means for withdrawing from the first distillation column a stream of argon-containing fluid whose argon concentration is greater than that of the air stream, said means communicating with a second distillation column for separating an argon product from the argon containing stream; and (i) means for withdrawing a vapor stream from a level of the mixing zone above that of the level from which said mixed stream is, in operation, withdrawn, but below the top of the mixing zone;

(j) means for condensing said vapor stream heat exchange with a stream of boiling liquid from one of the distillation columns and returning a stream of thus-formed condensate to the mixing zone; and (k) means for returning said boiled liquid to its respective distillation column.

12. Apparatus in accordance with claim 11, including means for sub-cooling said argon-containing stream and a throttling valve through which said sub-cooled argon-containing stream is passed into said second distillation column.

13. Apparatus in accordance with claim 11, wherein the second distillation column is provided with a reboiler for boiling liquid in or from the bottom of that column, said reboiler having an inlet in communication with an outlet of the bottom of the mixing zone and an outlet in communication with an inlet for reflux to the first distillation column.

14. Apparatus in accordance with claim 11, additionally including a condenser associated with the top of the second distillation column, said condenser being adapted to return a portion of argon condensed therein to the second column as reflux, there also being an outlet for liquid argon product in communication with said condenser.

* * * * *